United States Patent [19]

Hotta

[11] Patent Number: 5,057,737

[45] Date of Patent: Oct. 15, 1991

[54] COLOR PICTURE TUBE MASK FRAME

[75] Inventor: Tsuneo Hotta, Tokyo, Japan

[73] Assignee: NEC Corporation, Japan

[21] Appl. No.: 363,536

[22] Filed: Jun. 8, 1989

[30] Foreign Application Priority Data

Jun. 24, 1988 [JP] Japan ..... 63-83573[U]

[51] Int. Cl.[5] ..... H01J 29/81

[52] U.S. Cl. ..... 313/407

[58] Field of Search ..... 313/402, 407; 445/47

[56] References Cited

U.S. PATENT DOCUMENTS 4,645,968 2/1987 Ragland, Jr. ..... 313/407

4,949,009 8/1990 Iwamoto ..... 313/407

*Primary Examiner*—Donald J. Yusko

*Assistant Examiner*—Michael Horabik

*Attorney, Agent, or Firm*—Laff, Whitesel, Conte & Saret

[57] ABSTRACT

A color picture tube mask frame includes a mask frame body which has a rectangular shape and in which a skirt portion of a molded shadow mask is fitted. The skirt portion corresponds to a shape of the mask frame and is molded to surround an apertured portion having a large number of apertures at a central portion of the shadow mask and to extend in a direction substantially perpendicular to the apertured portion. The mask frame body has a groove formed at each corner on a skirt portion receiving side so as to receive a thick wall portion formed at a corresponding corner of the shadow mask.

4 Claims, 3 Drawing Sheets

COLOR PICTURE TUBE MASK FRAME

BACKGROUND OF THE INVENTION

The present invention relates to a color picture tube mask frame fitted on a molded shadow mask.

FIG. 1 is a plan view showing a shadow mask plate prior to press molding. A shadow mask plate 7*a* made of aluminum killed steel has notches 8 at its corners to prevent a skirt portion 4 from being longer at the corners than at other portions since a plate material tends to concentrate on corners during press molding. An apertured portion 5*a* has a large number of circular or slit-like apertures, and a nonapertured portion 5*b* as a peripheral portion surrounds the apertured portion 5*a*. Notches 4*a* are used to position the shadow mask plate in press molding.

FIGS. 2(*a*) and 2(*b*) show a rectangular shadow mask after press molding, in which FIG. 2(*a*) is a perspective view thereof and FIG. 2(*b*) is a sectional view thereof taken along the line II*b*—II*b* of FIG. 2(*a*). Referring to FIGS. 2(*a*) and 2(*b*), reference numeral 4 denotes a skirt portion; 5C, a spherical bead; 6, a corner thick wall portion formed at a notch 8; and 7, a molded shadow mask.

In general, since the molded shadow mask 7 is obtained by press-molding a relatively narrow area as the nonapertured portion 5*b* of a plate having a relatively small thickness (e.g., 0.13 mm), press moldability is improved by forming the corner notches 8. When each corner notch 8 is too large to form a gap at the corresponding corner after press molding to obtain the shadow mask 7, light leaks from the gap during the BM exposure as the postprocess, and the corner portion having the gap is exposed. Graphite is then not attached to the exposed corner portion. As a result, when the shadow mask 7 is assembled as a picture tube, the picture tube becomes defective because the non-blackened corner portion becomes a so-called film defect.

In order to prevent the above drawback, the thick wall portion 6 shown in FIG. 2(*b*) is formed at the corner notch 8, thereby preventing formation of a gap in the corner.

FIG. 3 is a perspective view showing a conventional mask frame 9. A fitting portion between the mask frame 9 and the molded shadow mask 7 has a size slightly smaller than a size of a punch of a shadow mask mold to assure a fitting margin. The outer appearance of the mask frame is similar to that of the punch. The mask frame 9 has a thickness larger than that of the molded shadow mask 7 and is subjected to perfect drawing. Therefore, the mask frame 9 does not require thick wall portions 6, unlike the shadow mask 7.

With the above structure, when press molding is performed for a long period of time, the punch of the mold is worn out to gradually increase the size of the thick wall portion 6. For this reason, when the shadow mask 7 shown in FIG. 2(*a*) is fitted in the mask frame 9 shown in FIG. 3, an amount LA of spread in the molded shadow mask 7 by the thick wall portions 6 is increased, as shown in FIG. 4, thereby undesirably causing mask deformation.

When the molded shadow mask 7 is connected to the mask frame 9 by a spot welding machine 10, stress acts on the spherical surface of the apertured portion 5*a* to distort the spherical surface. For this reason, when the molded shadow mask 7 is assembled as a picture tube, phosphor arrays of the picture tube are disturbed to cause so-called grouping, thereby greatly degrading the landing characteristics.

SUMMARY OF THE INVENTION

It is, therefore, a principal object of the present invention to provide a mask frame free from distortion and stress of a molded shadow mask even if a thick wall portion of the shadow mask is increased in size at a fitting portion between the molded shadow mask and the mask frame.

In order to achieve the above object of the present invention, there is provided a color picture tube mask frame comprising a mask frame body which has a rectangular shape as a whole and in which a skirt portion of a molded shadow mask is fitted from one side thereof, the skirt portion corresponding to a shape of the mask frame and being molded to surround an apertured portion having a large number of apertures at a central portion of the shadow mask and to extend in a direction substantially perpendicular to the apertured portion, and the mask frame body being provided with a groove formed at each corner on a skirt portion receiving side so as to receive a thick wall portion formed at a corresponding corner of the shadow mask.

BRIEF DESCRIPTION OF THE DRAWINGS

FIG. 2(*b*) is a sectional view of the molded shadow mask taken along the line II*b*—II*b* of FIG. 2(*a*);

DESCRIPTION OF THE PREFERRED EMBODIMENT

Figure 1:
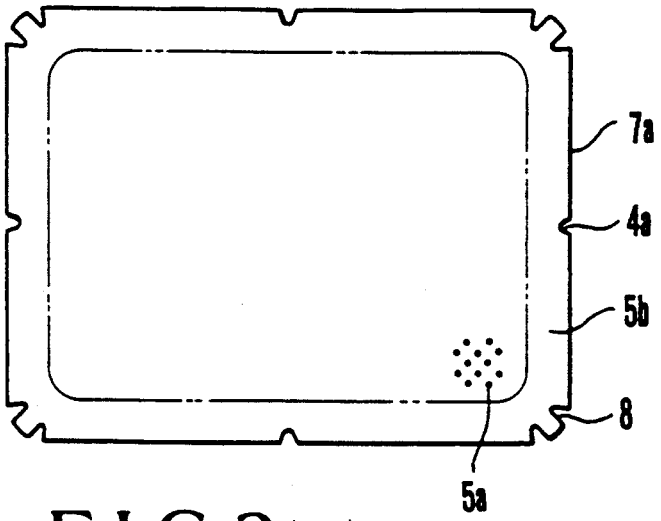
FIG. 1 is a plan view showing a shadow mask plate.
Figure 2A:
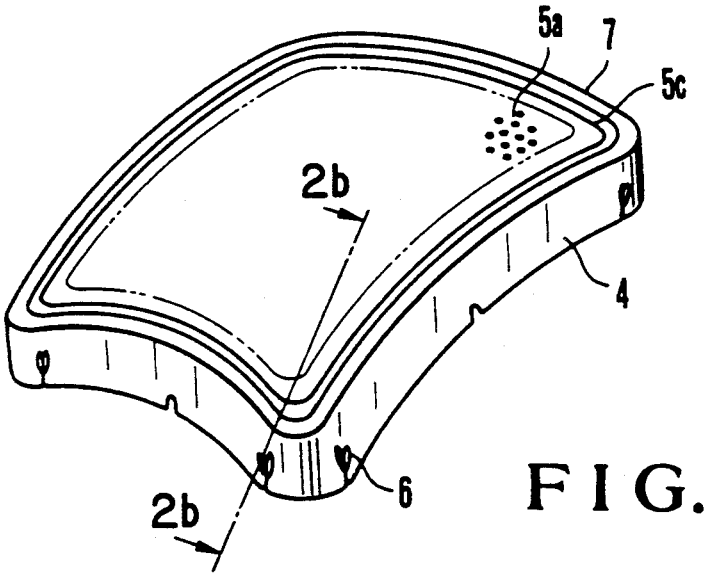
FIG. 2(*a*) is a perspective view of a shadow mask after press molding.
Figure 2B:
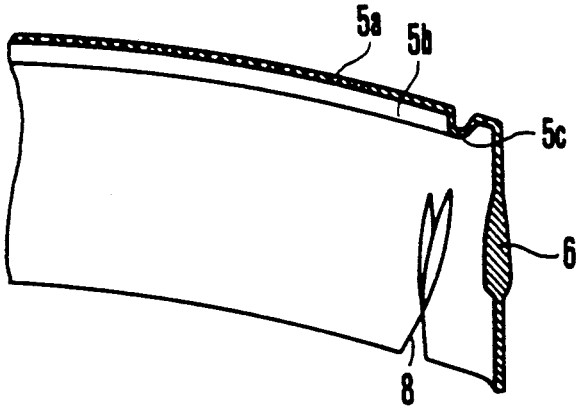
Figure 3:
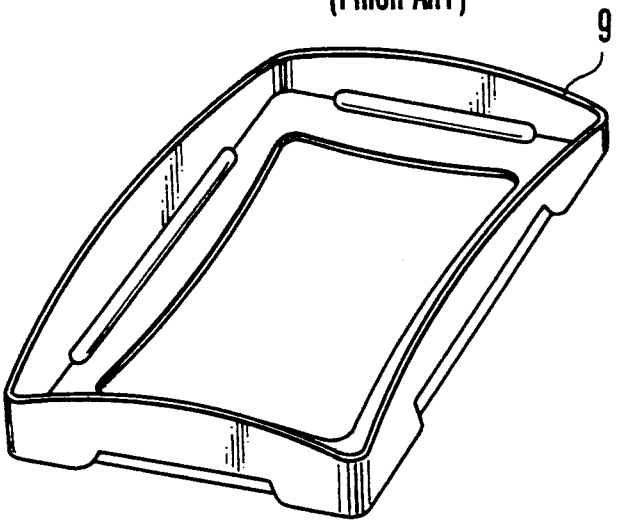
FIG.3 (PRIOR ART)
FIG. 3 is a perspective view showing a conventional mask frame.
Figure 4:
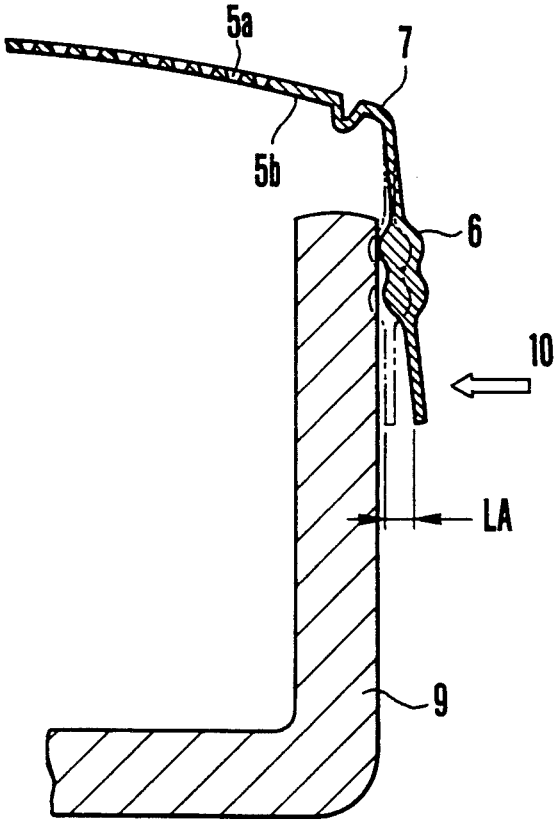
FIG. 4 is a sectional view showing a thick wall portion between the mask frame and the molded shadow mask.
Figure 5:
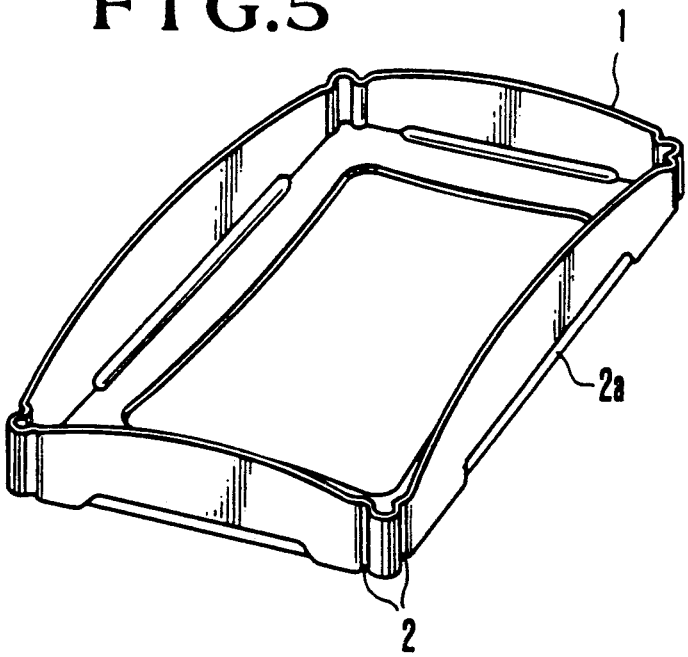
FIG. 5 is a perspective view showing a color picture tube mask frame according to an embodiment of the present invention.
Figure 6:
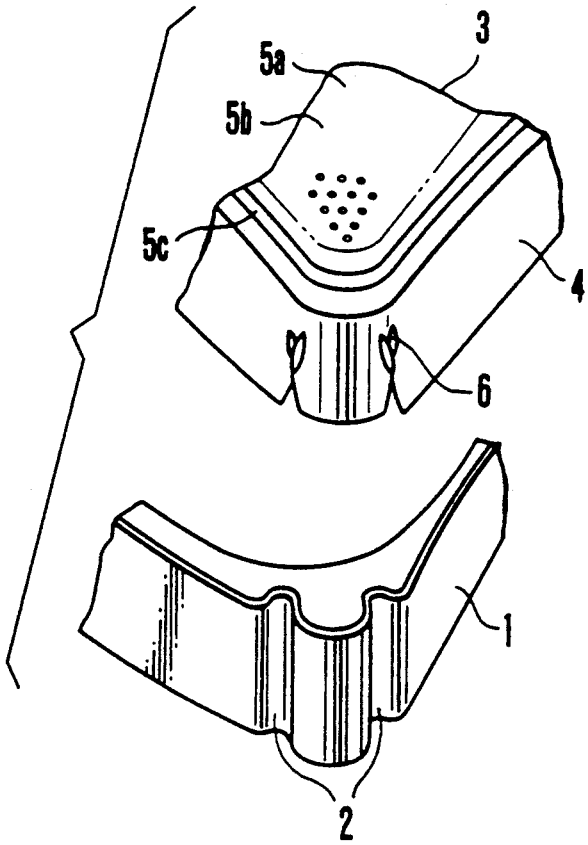
FIG. 6 is a perspective view showing a molded shadow mask and the mask frame.

FIG. 5 shows a mask frame according to an embodiment of the present invention. Referring to FIG. 5, reference numeral 1 denotes a mask frame made of a cold-rolled steel; 2, a corner recess as the characteristic feature of the present invention; and 2*a*, a bead. FIG. 6 is a perspective view showing a fitting state between the mask frame of the present invention and a molded shadow mask. The same reference numerals as in FIG. 2(*a*) denote the same parts in FIG. 5.

According to the present invention, as shown in FIG. 5, corner recesses (grooves) 2 for receiving thick wall portions 6 formed at the corners of a shadow mask 3 are formed at the corners of the mask frame 1, as shown in FIG. 5.

As shown in FIG. 6, the mask frame 1 has a fitting structure which receives the thick wall portions 6 of the corners of the molded shadow mask 3 in the recesses 2. Since the corner recesses 2 of the mask frame 1 receive the thick wall portions 6, respectively, the thick wall portions 6 of the molded shadow mask 3 are not brought into contact with the corresponding corners of the mask frame 1 during fitting.

According to the present invention, even if the thick wall portion of the corner of the molded shadow mask is increased by mold wear, a stress or the like does not act on the fitting portion between the molded shadow mask and the mask frame, thereby maintaining an excellent fitting state.

In the above embodiment, the recess 2 is formed from the upper edge to the lower edge of each corner of the mask frame 9 on the side in which the shadow mask 7 is fitted. However, each recess may be formed in the mask frame 9 by a depth corresponding to the length of the thick wall portion.

What is claimed is:

1. A color picture tube mask frame comprising a mask frame body which has a rectangular shape as a whole, a molded shadow mask having a skirt portion with notches at the corner, said skirt portion becomes thicker at the notches thereof during the formation thereof, said skirt portion of said molded shadow mask being fitted over said mask frame body from one side thereof, said skirt portion corresponding to a shape of said mask frame and being molded to surround an apertured portion having a large number of apertures at a central portion of said shadow mask and to extend in a direction substantially perpendicular to said apertured portion, and said mask frame body having a groove formed on each side of each corner on a skirt portion so as to receive said thicker wall portion having contours complementary to said grooves formed at corresponding corners of said shadow mask.

2. A mask frame according to claim 1, wherein said groove is formed from said skirt portion receiving side of said mask frame body to a depth corresponding to a length of said thicker wall portion of the corner of said shadow mask skirt portion.

3. A mask frame according to claim 1, wherein said groove formed on each of said side walls together constitutes a pair of grooves at each corner of said mask frame.

4. A color picture tube shadow mask assembly comprising:

a rectangular shadow mask having an apertured portion having a large number of apertures in a central portion thereof and a skirt portion with notches at the corners thereof, said skirt portion being obtained by forming a peripheral portion of said central portion to project in a direction which is perpendicular to said central portion; and a color picture tube mask frame for receiving said shadow mask along said skirt portion, wherein each corner of said mask frame which receives said skirt portion has a pair of grooves for receiving a thicker wall portion formed at said notches and having contours complimentary to said groove for fitting therein, said thicker wall portions being formed during a press molding of said shadow mask.

* * * * *